US006111484A

United States Patent [19]

Henningsson et al.

[11] Patent Number: 6,111,484

[45] Date of Patent: Aug. 29, 2000

[54] FILTER TUNING DEVICE AND TUNING PLATE INCLUDING A NUMBER OF SUCH DEVICES

[75] Inventors: Bo Uno Egon Henningsson, Nynäshamn; Sven Patrik Lindell, Järfälla, both of Sweden

[73] Assignee: Telefonaktiebolaget LM Ericsson, Stockholm, Sweden

[21] Appl. No.: 09/086,298

[22] Filed: May 28, 1998

[30] Foreign Application Priority Data

May 30, 1997 [SE] Sweden ..... 9702063

[51] Int. Cl.[7] ..... H01P 1/205; H01P 7/06

[52] U.S. Cl. ..... 333/231; 333/235; 333/207; 333/209

[58] Field of Search ..... 333/202, 207, 333/209, 223–226, 231–233, 235

[56] References Cited

U.S. PATENT DOCUMENTS

| | | | |
|---|---|---|---|
| 2,415,962 | 2/1947 | Okress | 333/231 X |
| 2,562,323 | 7/1951 | Martin | 333/233 |
| 3,121,205 | 2/1964 | Foss | 333/233 |
| 3,213,393 | 10/1965 | Powell et al. | 333/233 |
| 3,798,565 | 3/1974 | Jechart | 331/94 |
| 3,885,239 | 5/1975 | Zaleski | 333/232 X |
| 5,028,896 | 7/1991 | Kuokkanen | 333/224 X |
| 5,781,080 | 7/1998 | Ando | 333/134 X |
| 5,825,267 | 10/1998 | Smith | 333/235 |

FOREIGN PATENT DOCUMENTS

| | | |
|---|---|---|
| 0 519 308 | 12/1992 | European Pat. Off. . |
| 0 540 360 | 5/1993 | European Pat. Off. . |
| 3 935 785 | 5/1991 | Germany . |
| 4 113 302 | 10/1992 | Germany . |

*Primary Examiner*—Robert Pascal
*Assistant Examiner*—Barbara Summons
*Attorney, Agent, or Firm*—Burns, Doane, Swecker & Mathis, L.L.P.

[57] ABSTRACT

The present invention relates to a tuning device in radio filter equipment for mobile telephony in which one or more cavities in the equipment should be tuned to the right frequency. The invention also relates to a tuning plate including a number of such tuning devices. The tuning device preferably includes regular or square formed depressed parts in the tuning plate. The depressed part converges each to a square formed central plate which is provided with an elevation or bulb. By turning a tuning screw on the equipment a force is developed on the plate and the surrounding depressed parts. This implies that the tuning can be made automatically, more secure and with less risk for intermodulation.

7 Claims, 12 Drawing Sheets

FILTER TUNING DEVICE AND TUNING PLATE INCLUDING A NUMBER OF SUCH DEVICES

TECHNICAL FIELD OF THE INVENTION

The present invention relates generally to radio filters, e.g bandpass filters which may be in the HF-area, used in e.g. a mobile radio system, and more particularly to the tuning of such filters.

DESCRIPTION OF RELATED ART

Some kind of tuning arrangement is needed to tune a HF-filter to the right frequency. This may for example be done with a tuning screw alone or with a tuning plate where a tuning screw moves a part of the tuning plate.

A conventional BP(bandpass)-filter includes a body, a lid, filter cavities, center conductors, tuning screws, an input loop, an output loop and connectors. The walls of the filter cavities are formed by the inner surfaces of a filter casing. The filter casing is formed from the hollowed-out body and the lid. Center conductors are placed inside the filter cavities. Tuning screws for tuning the filter, that is the center conductors, to the right frequency are arranged in the lid and extend into the filter cavities. One tuning screw is arranged in the lid for every center conductor in the filter. Each of the center conductors are intended to receive and/or transmit radio signals within different frequencies. The input loop and the output loop are connected to connectors and the connectors can be connected with cables to functional units, such as printed circuit boards (PCB:s) and antennas. The arrangement of the various elements in a filter as described above are well known in the art. In typical state of the art systems, tuning screws with locking nuts are used. The filter is tuned by turning the screw until the right frequency for the corresponding center conductor is set. When this is done, the screw is fixed by tightening a locking nut on the screw. When the screw is turned the capacitance between the screw and the center conductor changes.

The tuning of a filter with a tuning plate is made in the same way, by rotating a tuning screw. The difference is that instead of using a locking nut to fix the tuning screw in position, a tuning plate can be used. The screw moves part of the tuning plate axially when the screw is rotated. This creates a tension in the tuning plate which increase the friction for the tuning screw when rotated and thus fixes the tuning screw in position. In this case the capacitance is changed by moving a part of the tuning plate. The screw only moves the plate and does not have a major impact on the change of capacitance. The state of the art tuning plate has bent slits formed in a rose pattern around each area of the tuning plate which corresponds to a tuning screw. The way the slits are formed enables the central part of the rose to move axially.

SUMMARY OF THE INVENTION

The present invention focuses on the tuning plate placed between the body and the lid. It can be seen that the present approaches, present problems. First, the tuning of the first type of state of the art filters that are tuned without using a tuning plate creates a problem when autotesting because of the need for two tools when tightening the locking nut. If a tuning screw with a locking nut is used, rotation of the locking nut by itself will also cause the screw to rotate. Therefore a second tool must be used to hold the screw while a first tool is used to tighten the locking nut. This method is cumbersome because it takes more time, more space, and the use of more tools than is necessary or optimal.

Secondly, when a state of the art tuning plate with bent slits in a rose pattern is used, the resistance to earth is relatively high and the currents do not take the shortest route to earth. To avoid intermodulation, IM, some of the tuning screws must be electrically isolated from the tuning plate, preferably with PTFE(teflon)-washers which are fastened on the tuning plate.

Normally the parts in a filter are manufactured with high precision on the surfaces which form the contact surfaces between the tuning plate and the body, and the joining is made by using screws. To minimize the electromagnetic radiation (EMC) the electrical contact between the casted part, that is the body, and the tuning plate must be excellent. To fulfil the requirements for the high working frequencies (around 1.8 Ghz) for the filters, the distance between the screws must be relatively small (around 20 mm) which means that the number of screws needed in a filter is significant.

Another factor which also emphasizes the need for good contact between the body and the lid, is the risk for intermodulation (IM). Holes in the tuning plate should be made with a minimal total area for minimizing the risk for IM.

Accordingly, one object of the present invention is to minimize the problems of having slits in the tuning plate by minimizing the area of the slits. Another object of the invention is to minimize the problem of the currents not taking the shortest route to earth by using straight slits instead of the curved slits used in the state of the art tuning plate. Yet another object of the invention is the use of spring-elements integrated in the tuning plate to obtain good contact between the body and the tuning plate and in this way minimizing the risk for intermodulation (IM). To minimize the electromagnetic radiation (EMC) the electrical contact between the body and the tuning plate is excellent due to the springs in the tuning plate.

The central idea in the invention is to make a tuning plate with tuning units with straight and narrow slits that reach out diagonally from a center square and to have multiple depressions in the tuning plate in each tuning unit so that the tuning plate is wave-formed around the center square in order to minimize the resistance to earth, to improve the IM characteristics and to allow a sufficient movement of the plate in the axial direction of a tuning screw. A sufficient movement in this case means at least 2–3 mm.

It is the combination of the slits and the depressions that makes a functional and advantageous solution possible.

The result will be a filter which is possible to tune automatically, which is more cost effective and which has less risk for intermodulation.

If the tuning plate with the tuning units and springs is designed according to the preferred embodiment of the invention, the number of fastening screws in the lid may be reduced by approximately 60% compared to the state of the art solution.

Tuning and electrical sealing function is united in one detail, that is in the tuning plate.

When using the solution with depressions and four slits the area of the tuning plate cooperating with the center conductor is increased by 50% compared with the state of the art system. The filter is easier to tune if the area is larger ($C=\epsilon*A/d$).

The force needed to tune the filter is decreased by a factor around 2–4 due to the easier movement of the tuning unit compared with the the rose-formed state of the art pattern which means that the thickness of the tuning plate may be decreased.

The area of the holes in the tuning plate may be decreased to around half the area needed today by using the straight and narrow slits that reach out diagonally from the center square.

No electrically isolating PTFE(teflon)-washers are needed on the tuning plate to isolate some of the tuning screws from the tuning plate because of the smaller area of the slits in the tuning plate and because of the better contact between the body and the tuning plate.

BRIEF DESCRIPTION OF THE DRAWINGS

The present invention will now be described in more detail with reference to preferred embodiments of the present invention, given only by way of example, and illustrated in the accompanying drawings, in which.

DETAILED DESCRIPTION OF EMBODIMENTS

Briefly described, the present invention provides an apparatus for tuning of radio/BP-filters used in e.g. mobile radio systems. The present invention focuses on the tuning plate 300 placed between the body 111 and the lid 110.

Figure 1:
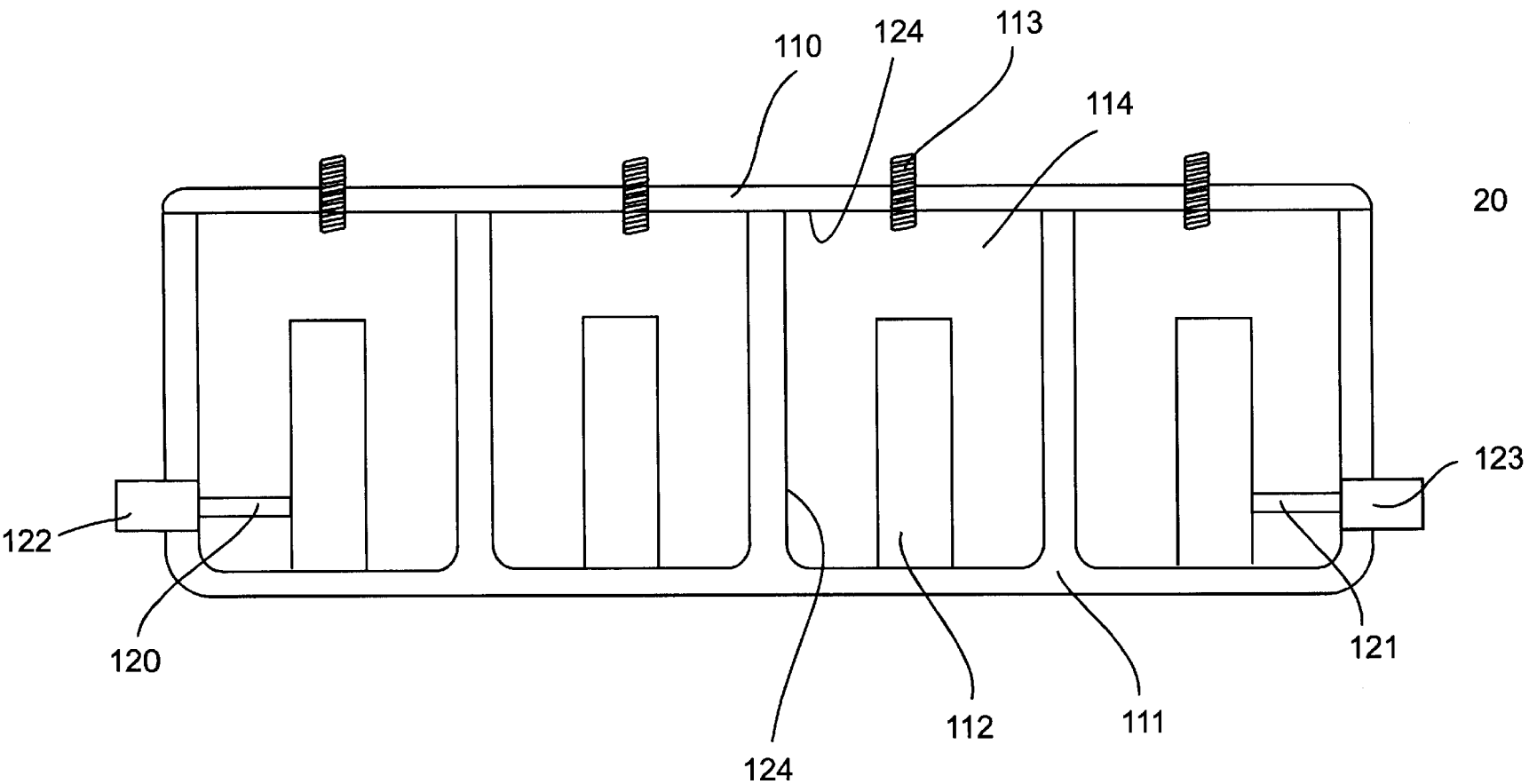
Fig. 1 PRIOR ART
FIG. 1 schematically illustrates a side cutaway view of a state of the art filter for e.g a mobile telephone system.
Figure 3:
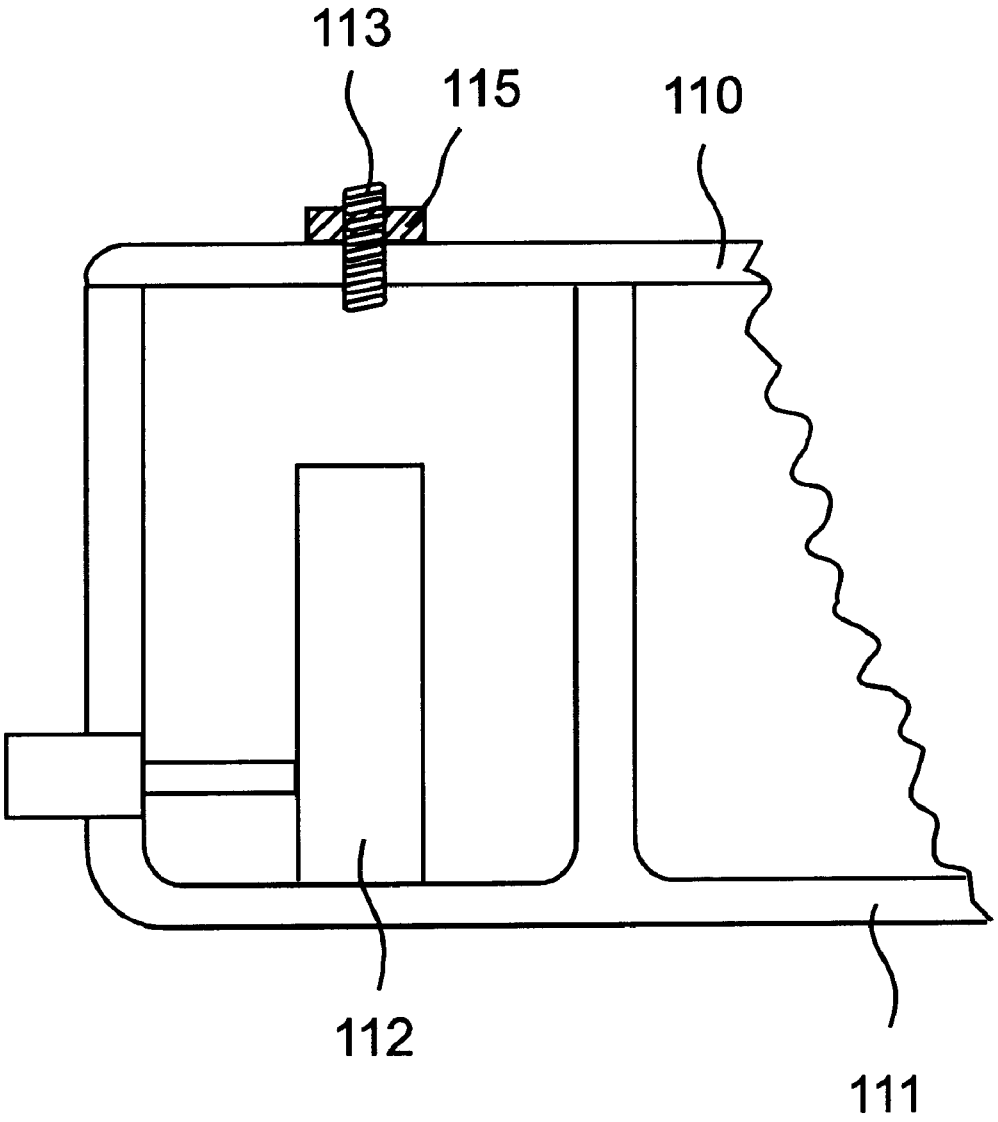
Fig. 3 PRIOR ART
FIG. 3 schematically illustrates a side cutaway view of one cavity in a state of the art filter for e.g a mobile telephone system.

FIG. 1 schematically illustrates a side cutaway view of a state of the art filter 20 for e.g a mobile telephone system. A conventional BP(bandpass)-filter includes a body 111, a lid 110, filter cavities 114, center conductors 112, tuning screws 113, an input loop 120, an output loop 121 and connectors 122, 123. The walls 124 of the filter cavities 114 are formed by the inner surfaces of a filter casing. The filter casing is formed from the hollowed-outbody 111 and the lid 110. Center conductors 112 are placed inside the filter cavities 114. Tuning screws 113 for tuning the filter, that is the center conductors 112, to the right frequency are arranged in the lid 110 and extend into the filter cavities 114. One tuning screw 113 is arranged in the lid 110 for every center conductor 11 in the filter. Each of the center conductors 112 are intended to receive and/or transmit radio signals within different frequencies. The input loop 120 and the output loop 121 are connected to connectors 122, 123 and the connectors 122, 123 can be connected with cables (not shown) to functional units (not shown), such as printed circuit boards (PCB:s) and antennas. The filter is tuned by turning the screw 113 until the right frequency for the corresponding center conductor 112 is set. When this is done, the screw 113 is fixed by tightening a locking nut 115 as can be seen in FIG. 3 on the screw 113. When the screw 113 is turned the capacitance between the screw 113 and the corresponding center conductor 112 changes.

Figure 2:
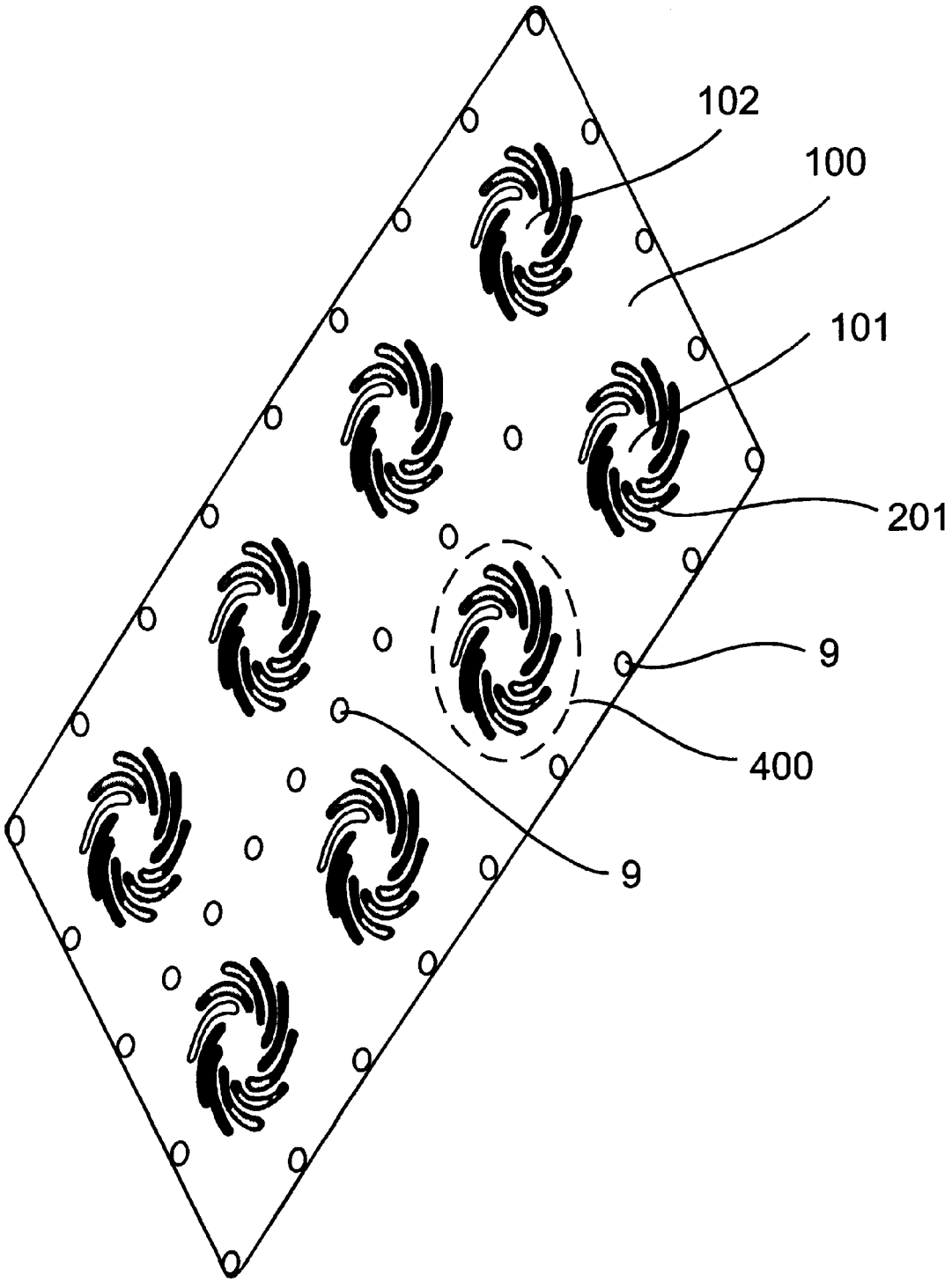
Fig. 2 PRIOR ART
FIG. 2 schematically illustrates a perspective view of a state of the art tuning plate with holes for the screws joining body, tuning plate and lid for a filter in e.g a mobile telephone system.
Figure 11:
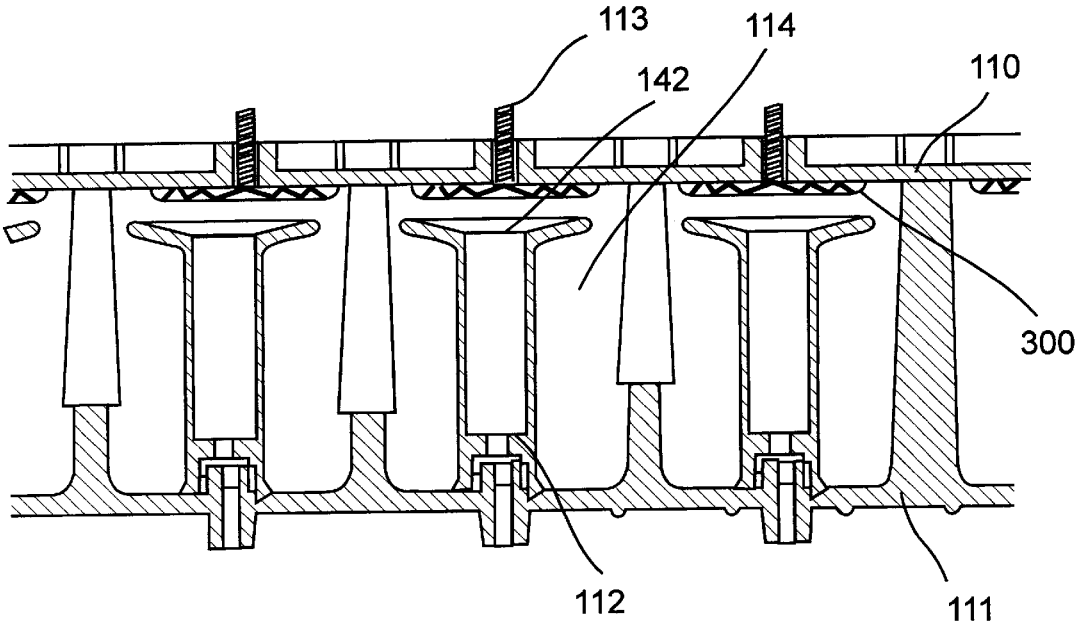
Figure 12:
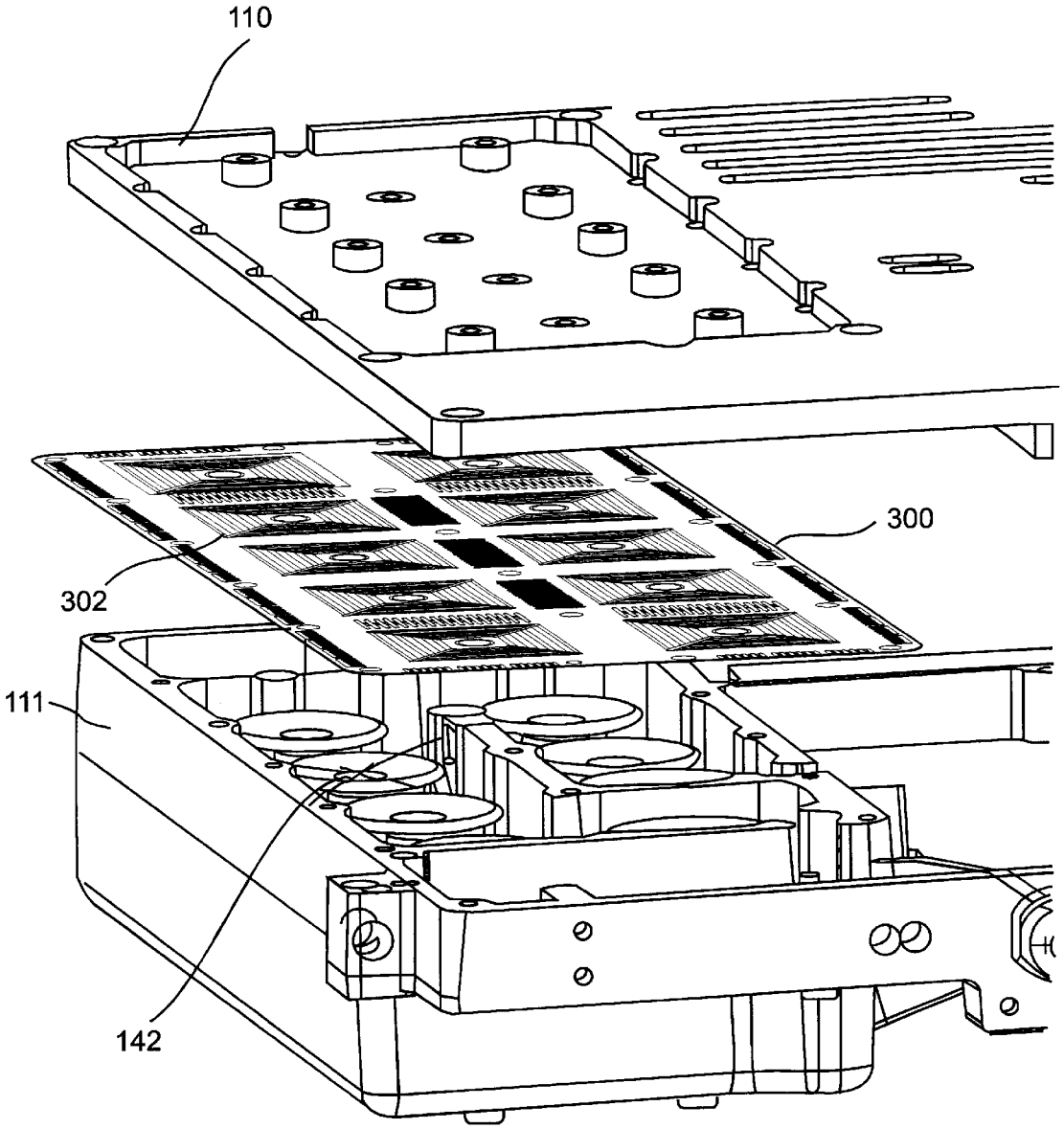
FIG. 12 schematically illustrates a perspective view of a filter with a tuning plate.

The tuning of a filter with a tuning plate 100, 300 is made in the same way, by rotating a tuning screw 113 until the right frequency is set. In the filter the tuning plate is placed between the base and the lid as can be seen in FIG. 11. The difference is that instead of using a locking nut 115 to fix the tuning screw 113 in position, a tuning plate 100,300 can be used. The screw 113 moves part of the tuning plate 100, 300 axially when the screw 113 is rotated. This creates a tension in the tuning plate 100, 300 which increase the friction for the tuning screw 113 when rotated and thus fixes the tuning screw 113 in position. If more friction is needed, a plastic coated screw, also called a stop screw, may be used. When using a tuning plate the capacitance is changed by moving a part of the tuning plate, the tuning unit. In the state of the art tuning plate 100 shown in FIG. 2 the tuning unit 400 is equivalent with the area containing the bent slits 201 in a rose-pattern. The way the slits 201 are formed enables the central part 101 of the rose to move axially. The center 102, 302 of the tuning unit in the tuning plate is placed above the center 142 of the corresponding center conductor. The screw 113 only moves the plate 100, 300 and does not have a major impact on the change of capacitance.

A mechanically adjustable capacitance is provided, for example a tuning screw 113 in combination with a tuning plate, where the tuning screw may or may not be in direct electrical contact with the tuning plate.

When a state of the art tuning plate 100 with bent slits 201 in a rose pattern is used, the resistance to earth is relatively high and the currents do not take the shortest route to earth. To avoid intermodulation, IM, some of the tuning screws 113 must be electrically isolated from the tuning plate, preferably with PTFE(teflon)-washers which are fastened on the tuning plate (not shown).

Figure 4:
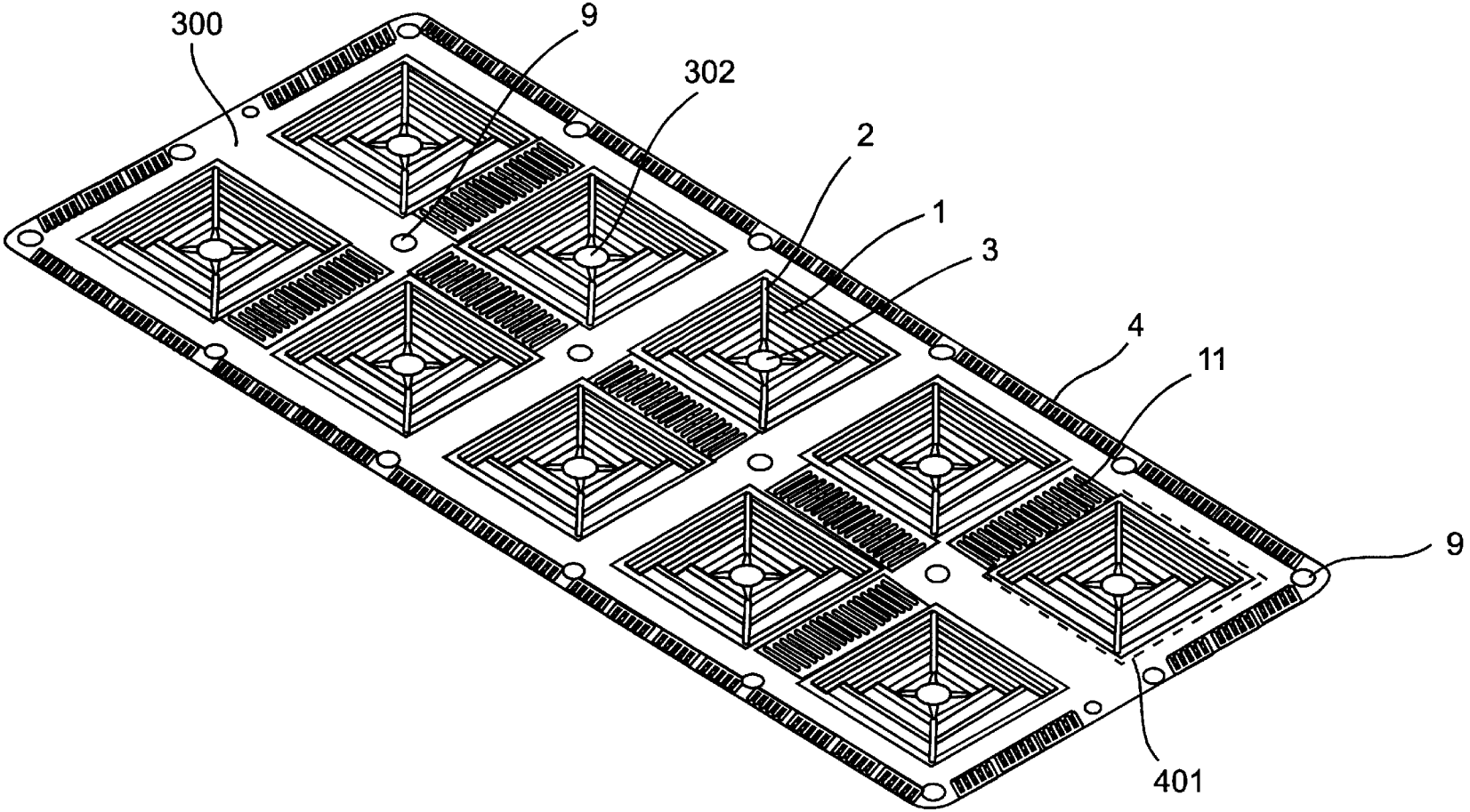
FIG. 4 schematically illustrates a perspective view of the preferred embodiment of the present invention.

FIG. 4 schematically illustrates a perspective view of the preferred embodiment of the invention. The tuning plate 300 has, in this embodiment, ten tuning units 401.

Figure 5:
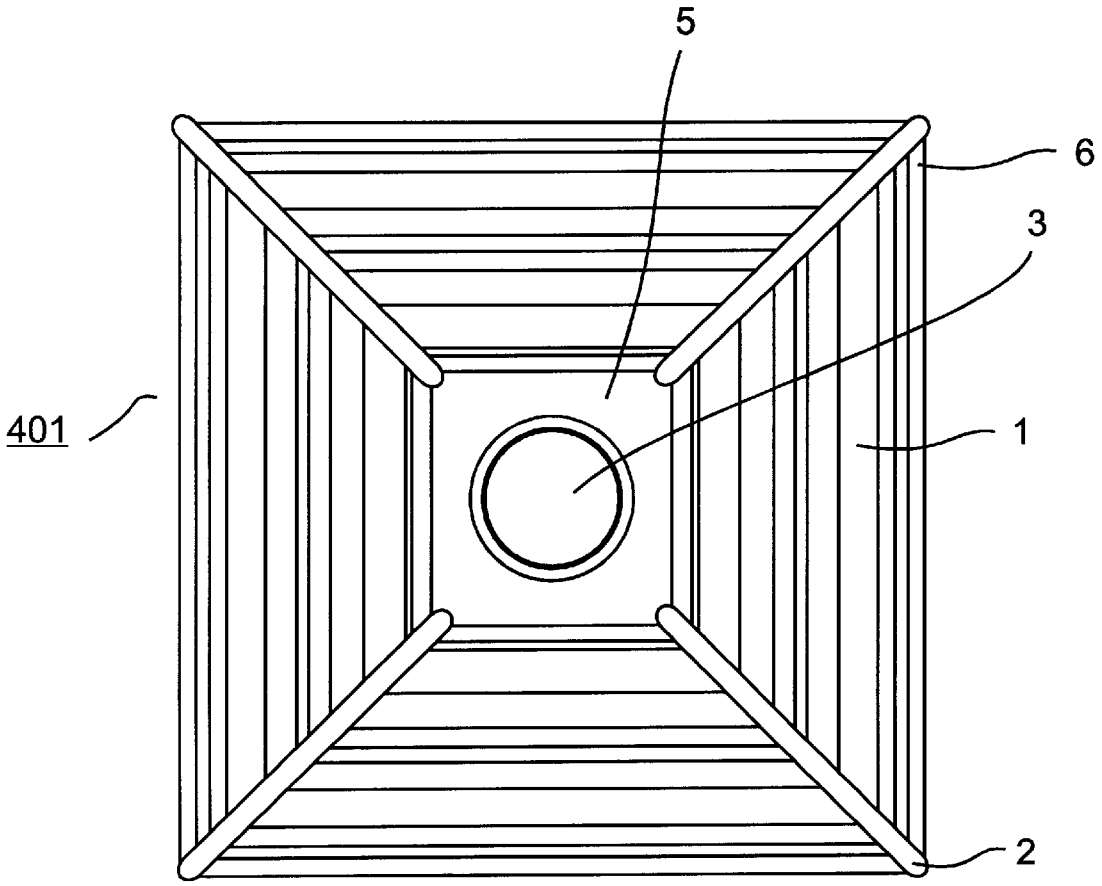
FIG. 5 schematically illustrates a top view of the preferred embodiment of the tuning plate where depressions and slits in one tuning unit are shown.
Figure 6:
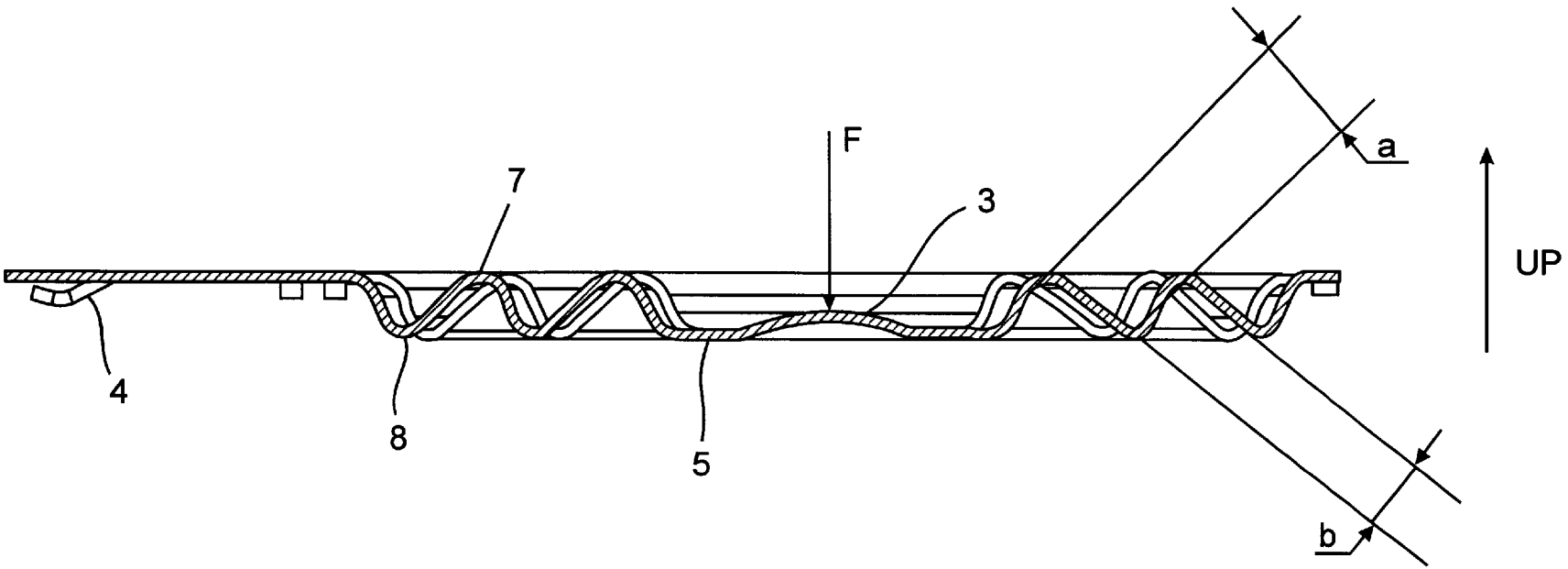
FIG. 6 schematically illustrates a side cutaway view of the depressions in one tuning unit of the preferred embodiment of the present invention.

FIG. 5 illustrates schematically a top view of the tuning plate 300 where depressions 1, slits 2 and the bump 3 in one tuning unit 401 accordning to one embodiment are shown. The tuning plate has depressions 1 and slits 2. The depressions 1 are integrated in the tuning plate 300 and formed with different lengths (a,b) as shown in FIG. 6 which is important in order to obtain a soft movement in the plate. The distance (a) should be longer than distance (b) and the angle between distance (a) and (b) should be around 90°, preferably more than 90° to obtain a soft movement.

In the center of a tuning unit an elevated area, a bump 3 is made in order to absorb the force (F) from the tuning screw. The bump is placed in the middle of a square 5. The slits 2 extend radially on the tuning plate and beyond the outmost depression 6 as can be seen in FIG. 5. The tuning plate is wave formed between the slits 2.

This means that the depressions 1 are formed as a series of ridges 7 and valleys 8 and that these ridges 7 and valleys 8 are formed as squares with slits 2 cutting the squares in four substantially identical parts. Another geometrical forms, such as circles or polygons are also possible.

FIG. 6 schematically illustrates a side cutaway view of the depressions around one tuning point of the preferred embodiment of the present invention.

Figure 7:
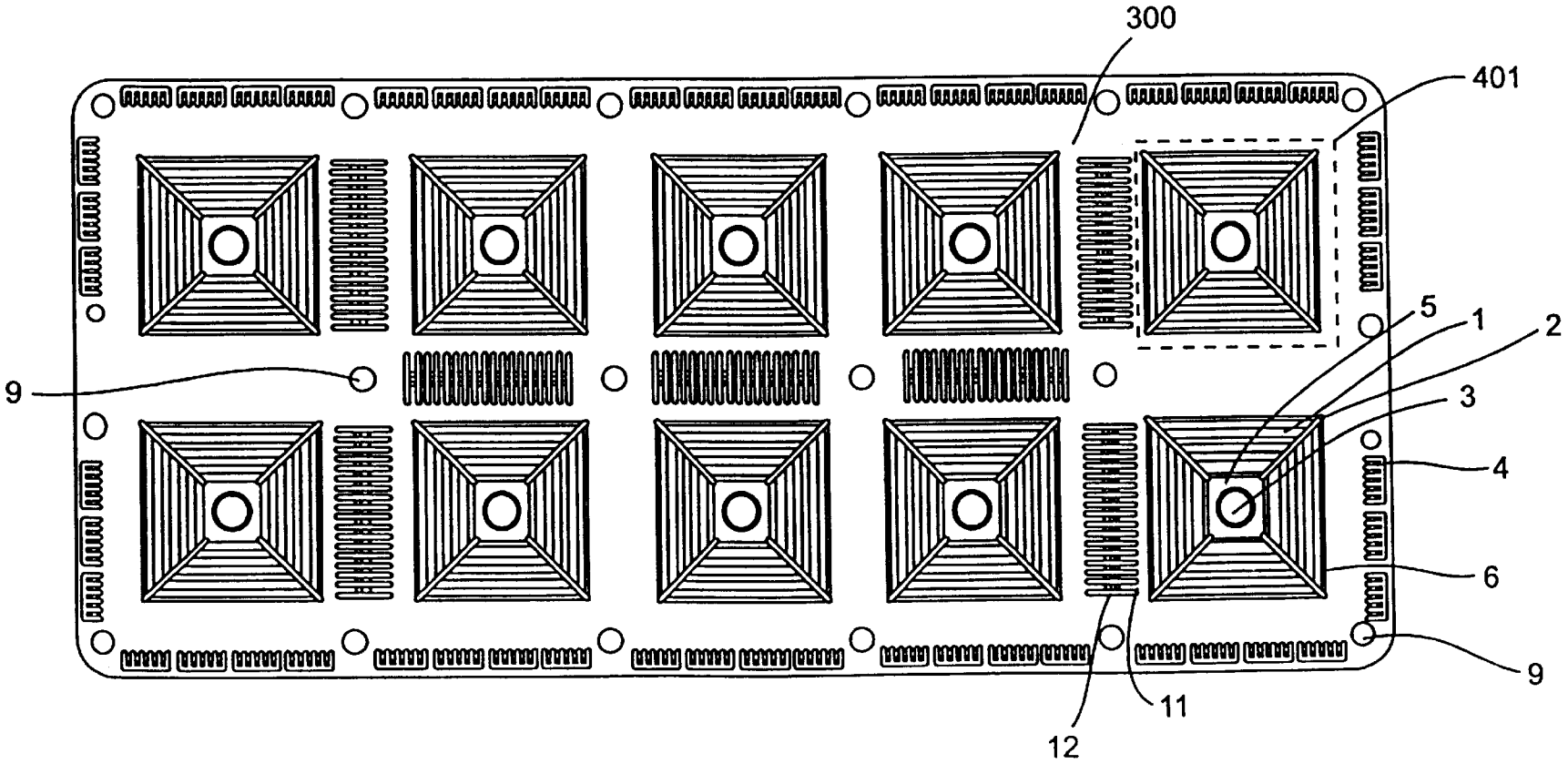
FIG. 7 schematically illustrates a top view of the preferred embodiment of the tuning plate where springs between the tuning units, at the edge of the tuning plate, holes for screws for the joining of the base, lid and tuning plate and also depressions and slits in ten tuning units are shown.

FIG. 7 schematically illustrates a top view of the preferred embodiment of the tuning plate 300 where springs 4 at the edges of the tuning plate, springs 11 between the tuning units 401, holes 9 for screws for the joining of the base 111, lid 110 and tuning plate 300 and also depressions 1, slits 2 and bumps 3 in ten tuning units 401 are shown. The plate 300 is preferably 0.3 mm thick and is preferably made of silver-electroplated-brass. The tuning plate is shielded, that is earthed with the help of the springs 4, 11. The central idea in the invention is to make a tuning plate 300 with tuning units 401 with straight and narrow slits 2 that reach out diagonally from a center square 5 and to have multiple depressions 1 in the tuning plate 300 in each tuning unit so that the tuning plate is wave-formed around the center square 5 in order to minimize the resistance to earth, to improve the IM characteristics and to allow a sufficient movement of the plate in the axial direction of a tuning screw 113. It is the combination of the slits 2 and the depressions 1 that makes a functional and advantageous solution possible.

The wave form consists of depressions with two ridges 7 and two valleys 8 in the following order: level center square 5, ridge 7, valley 8, ridge 7, valley 8, level surface of the tuning plate 300. The ridges 7 are on the same level as the tuning plate and the valleys 8 are on the same level as the center square 5 as shown in FIG. 6.

Figure 8:
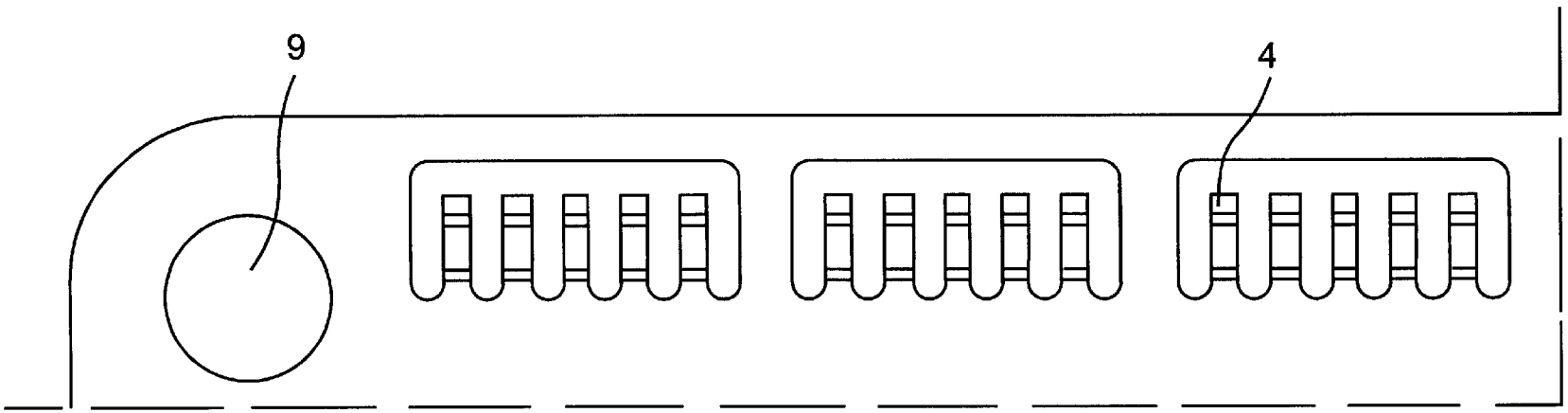
FIG. 8 schematically illustrates the preferred embodiment of the spring-elements placed at the edge of the tuning plate of the present invention.

FIG. 8 schematically illustrates the preferred embodiment of the springs 4 placed at the edge of the tuning plate. The springs are integrated in the tuning plate and made by removing material from the tuning plate. A hole 9 for a screw joining the base 111, lid 110 and the plate 300 together is also shown.

Figure 9B:
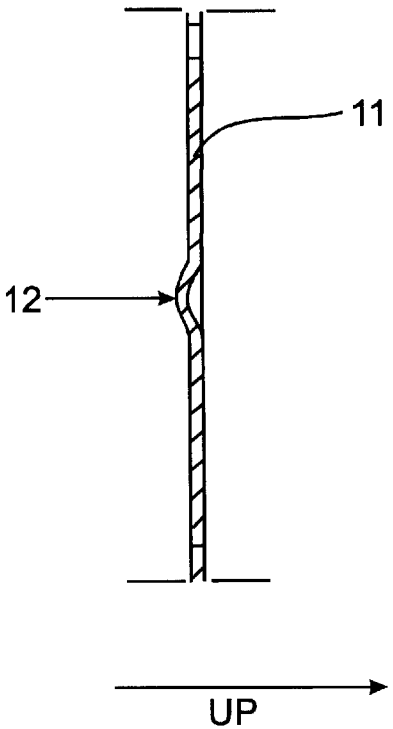
FIG. 9*b* schematically illustrates a top view of the preferred embodiment of the spring elements between two tuning units in the tuning plate.
Figure 9A:
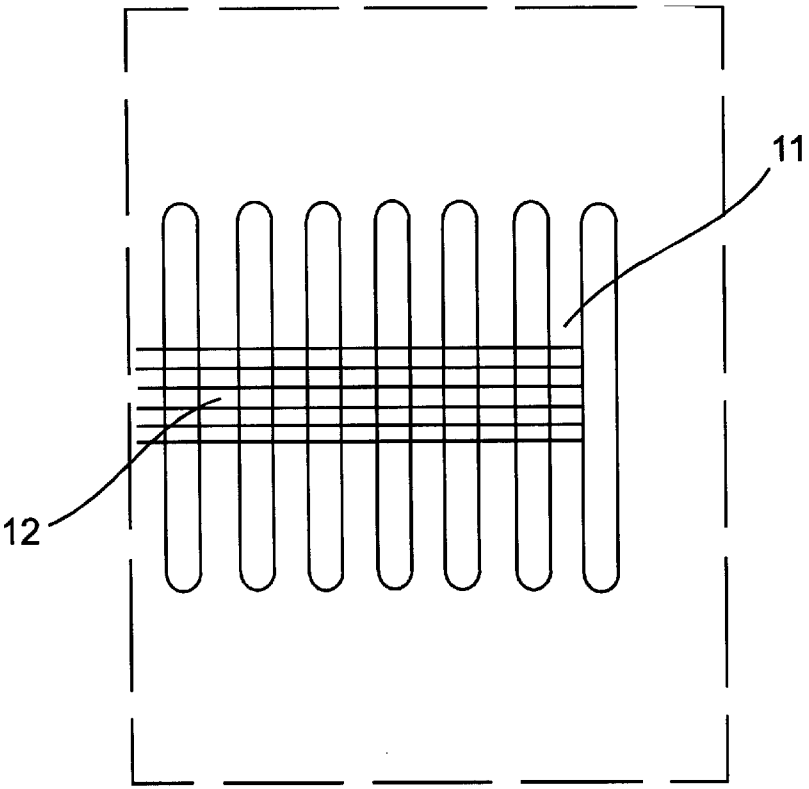
FIG. 9*a* schematically illustrates a side view of the preferred embodiment of the spring elements between two tuning units in the tuning plate.

FIG. 9*a* schematically illustrates a top view of the preferred embodiment of the springs 11 between two tuning units 401 in the tuning plate 300. These springs 11 are made by removing material from the tuning plate 300.

FIG. 9*b* schematically illustrates a side view of the preferred embodiment of the spring elements 11 between two tuning units 401 in the tuning plate 300. The figure shows how these springs 11 are bent to make better contact with the base by contacting in one point 1

Figure 10:
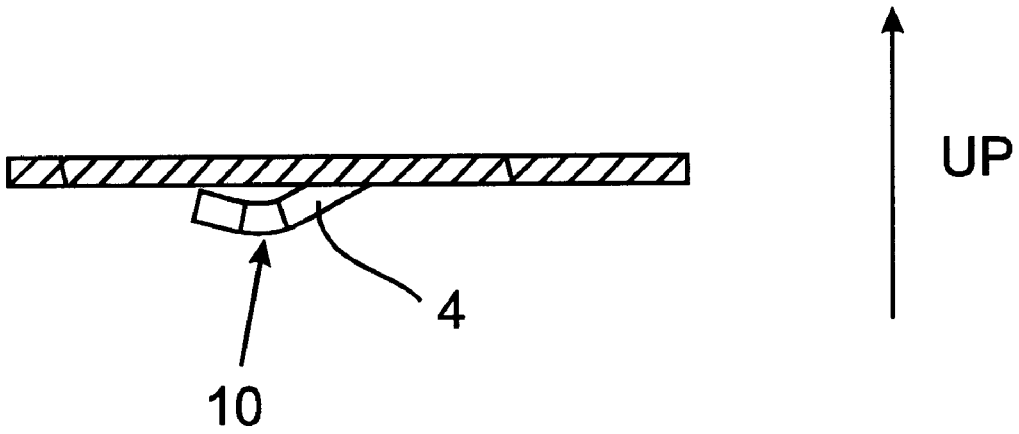
FIG. 10 schematically illustrates a side view of one spring at the edge of a tuning plate of the present invention FIG. 11 schematically illustrates a side cutaway view showing where the present invention would be located in a filter for e.g a mobile telephone system.

FIG. 10 schematically illustrates a side view of one spring at the edge of the tuning plate 300. The tuning plate is grounded in the boxwall of the filter. The spring 4 is an elongated member integrated in a tuning plate 300. The springs improve the contact between the body 111 and the tuning plate 300. The spring 4 is simple to manufacture and has a flexible design and a very good contact with a relatively short distance (around 1.5 mm) between the springs 4. Each spring 4 is bent as shown in FIG. 10, so that contact between the base 111 and each spring 4 is made only in a point 10 and not in a large area. Usually the filters for radio base stations which are tuned using a tuning plate are manufactured using a casted part with the filter cavities (here called the base 111), a tuning plate 300 and a lid 110.

Although the embodiments described above both use a screw to create the adjustment of the capacitance, other types of adjusting means and capacitance means may be used. The use of the screw especially provides a more convenient method for automatic testing by using robots to merely turn the screw. It also means that when tuning the filter only one tool is needed. Although the embodiments described above both use a screw to create the adjustment of the capacitance, other types of adjusting means and capacitance means may be used. The use of the screw especially provides a more convenient method for automatic testing by using robots to merely turn the screw. It also means that when tuning the filter only one tool is needed.

It is apparent that one or more tuning plates may be placed in one filter, that each tuning plate has one or several tuning points, that the springs may be separate elements which are fastened to the tuning plate or the body, that a filter may have one or more cavities and that the number of ridges and valleys in the wave-formed parts of the tuning plate may be one or more without departing from the spirit of the invention.

The embodiments described above serve merely as illustration and not as limitation. It will be apparent to one of ordinary skill in the art that departures may be made from the embodiments described above without departing from the the spirit and scope of the invention. Therefore, the invention should not be regarded as being limited to the examples described, but should be regarded instead as being equal in scope to the following claims.

What is claimed is:

1. A tuning device arranged on a tuning plate for use in a radio equipment in which tuning of the equipment is made by using a tuning force directed substantially perpendicular towards said tuning plate, comprising a) a number of depressed parts, said parts being depressed in relation to said plate, each part being so designed as to form a corrugated surface converging towards a common point forming a substantially triangular portion whose upper part is truncated and integrated with a central plate, the base part of said triangular portion being integrated with the tuning plate;

b) said central plate integrated with each of said depressed parts in order to receive said tuning force, said depressed parts being separated from each other but integrated with said central plate and converging towards a center of the central plate.

2. Tuning device as claimed in claim 1, wherein said central plate is provided with an elevated portion in the center of the plate in order to receive said tuning force.

3. Tuning device as claimed in claim 1, wherein said triangular portion is corrugated in the form of a wavy pattern.

4. Tuning device as claimed in claim 3, wherein said wavy pattern is asymmetric so that a downwards directed part in relation to said tuning force is different in length than an upwards directed part.

5. A tuning plate in a radio equipment said equipment comprising a number of cavities, the electrical properties of which are to be tuned, and including a number of tuning devices each of the tuning devices comprising a) a number of depressed parts, said parts being depressed in relation to said plate, each part being so designed as to form a corrugated surface converging towards a common point forming a substantially triangular portion whose upper part is truncated and integrated with a central plate, the base part of said triangular portion being integrated with the tuning plate; and b) said central plate integrated with each of said depressed parts in order to receive said tuning force, said depressed parts being separated from each other but integrated with said central plate and converging towards a center of the central plate;

wherein the tuning devices are arranged side by side integrated on the tuning plate and positioned in relation to each of the cavities.

6. Tuning plate as claimed in claim 5, wherein spring elements are arranged between two adjacent tuning devices which contact the radio equipment in order to earth the tuning plate.

7. Tuning plate as claimed in claim 6, wherein a number of spring elements are arranged in parallel side by side at an edge part of the tuning plate proximate to the tuning device.

* * * * *